US011817052B2

(12) United States Patent
Zhao

(10) Patent No.: US 11,817,052 B2
(45) Date of Patent: Nov. 14, 2023

(54) ORGANIC LIGHT-EMITTING DISPLAY PANEL AND DISPLAY METHOD THEREFOR

(71) Applicant: BOE TECHNOLOGY GROUP CO., LTD., Beijing (CN)

(72) Inventor: Lijun Zhao, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 1337 days.

(21) Appl. No.: 16/318,859

(22) PCT Filed: Apr. 24, 2018

(86) PCT No.: PCT/CN2018/084195
§ 371 (c)(1),
(2) Date: Jan. 18, 2019

(87) PCT Pub. No.: WO2018/205827
PCT Pub. Date: Nov. 15, 2018

(65) Prior Publication Data

US 2023/0196996 A1 Jun. 22, 2023

(30) Foreign Application Priority Data

May 11, 2017 (CN) ..... 201710329211.3

(51) Int. Cl.
*G09G 3/3233* (2016.01)

(52) U.S. Cl.
CPC ... *G09G 3/3233* (2013.01); *G09G 2300/0819* (2013.01); *G09G 2300/0852* (2013.01);
(Continued)

(58) Field of Classification Search
CPC ..... G06F 1/206; G06F 1/3265; G06F 3/1407; G09G 3/20; G09G 3/2096; G09G 2310/08;
(Continued)

(56) References Cited

U.S. PATENT DOCUMENTS

2004/0061670 A1* 4/2004 Muruyama ..... G09G 3/3216 345/76
2005/0285823 A1 12/2005 Kimura et al.
(Continued)

FOREIGN PATENT DOCUMENTS

CN 1703121 A 11/2005
CN 103730088 A 4/2014
(Continued)

OTHER PUBLICATIONS

International Search Report and Written Opinion dated Jul. 24, 2018.
First Chinese Office Action dated Oct. 30, 2018.

*Primary Examiner* — Nelson M Rosario
(74) *Attorney, Agent, or Firm* — Dilworth & Barrese, LLP.; Michael J. Musella, Esq.

(57) ABSTRACT

Disclosed are an organic light-emitting display panel and a display method thereof. The temperature of the organic light-emitting display panel can be detected in a pre-set detection period by arranging a temperature detection and compensation module, when it is determined that the temperature of the organic light-emitting display panel is not within a pre-set temperature range, a temperature compensation voltage corresponding to the organic light-emitting display panel is determined according to the detected temperature of the organic light-emitting display panel; and when each light-emitting device emits light, the determined temperature compensation voltage is applied to an anode of the light-emitting device that emits light so as to carry out voltage compensation on an anode voltage of the light-emitting device.

16 Claims, 10 Drawing Sheets

(52) U.S. Cl.
CPC . *G09G 2300/0861* (2013.01); *G09G 2310/08* (2013.01); *G09G 2320/0233* (2013.01); *G09G 2320/0242* (2013.01); *G09G 2320/041* (2013.01)

(58) Field of Classification Search
CPC ..... G09G 2320/041; G09G 2320/043; G09G 2330/021; G09G 2330/045; G09G 2340/0435; G09G 2360/18; G09G 2370/02; G09G 3/3208; Y02D 10/00
See application file for complete search history.

(56) References Cited

U.S. PATENT DOCUMENTS

| | | | |
|---|---|---|---|
| 2012/0139955 | A1 | 6/2012 | Jaffari et al. |
| 2013/0321361 | A1 | 12/2013 | Lynch et al. |
| 2014/0104259 | A1 | 4/2014 | Oh et al. |
| 2015/0154910 | A1 | 6/2015 | Okuno |
| 2017/0124959 | A1* | 5/2017 | Kim ..... G09G 3/3225 |
| 2017/0169761 | A1 | 6/2017 | Ma |
| 2018/0158428 | A1 | 6/2018 | Liu et al. |
| 2018/0218662 | A1 | 8/2018 | Hu et al. |

FOREIGN PATENT DOCUMENTS

| | | | |
|---|---|---|---|
| CN | 104036749 | A | 9/2014 |
| CN | 104350536 | A | 2/2015 |
| CN | 104835452 | A | 8/2015 |
| CN | 105096880 | A | 11/2015 |
| CN | 105679265 | A | 6/2016 |
| CN | 105741811 | A | 7/2016 |
| CN | 105913803 | A | 8/2016 |
| CN | 106356024 | A | 1/2017 |
| CN | 206057738 | A | 3/2017 |
| CN | 106960656 | A | 7/2017 |
| KR | 1020050106834 | A | 11/2005 |
| KR | 1020150062968 | A | 6/2015 |
| KR | 1020170023618 | A | 3/2017 |

* cited by examiner

ORGANIC LIGHT-EMITTING DISPLAY PANEL AND DISPLAY METHOD THEREFOR

TECHNICAL FIELD

The present disclosure relates to an organic light-emitting display panel and a display method thereof.

BACKGROUND

With the development of display technology, more and more AMOLED (Active Matrix Organic Light-emitting Diode) display panels have entered the market. Compared with traditional TFT LCD (Thin Film Transistor Liquid Crystal Display), AMOLED display panels have the advantages such as low energy consumption, low manufacturing costs, self-illumination, wide viewing angle and fast response. At present, in the display fields of mobile phone, personal digital assistant (PDA), digital camera, etc., AMOLED display panels have begun to gradually replace the traditional LCD display panels. Unlike TFT-LCD display panels, which use a stable voltage to control brightness, AMOLED display panels are current-driven and require a stable current to control brightness. Existing OLEDs generally consist of an anode, a luminescent material, and a cathode which are stacked. The luminescence property of the luminescent material changes obviously with temperature. For example, if the temperature is lowered, the luminescence brightness of the OLED will decrease, thereby causing color-bias of the luminescence, thereby affecting the display effect of the OLED display panel.

SUMMARY

Embodiments of the present disclosure provide an organic light-emitting display panel, including a plurality of light-emitting elements, wherein the organic light-emitting display panel further includes: a temperature detection and compensation module electrically connected to anodes of the respective light-emitting elements; the temperature detection and compensation module is configured to: detect a temperature of the organic light-emitting display panel during a pre-set detection period, to determine a temperature compensation voltage corresponding to the organic light-emitting display panel according to the temperature detected by the temperature detection module when it is determined that the temperature of the organic light-emitting display panel is not within a pre-set temperature range, and to apply the temperature compensation voltage as detected to the anodes of the light-emitting elements when the organic light-emitting elements emit light.

In an embodiment according to the present disclosure, for example, the temperature detection and compensation module includes: a signal input sub-module, a voltage storage sub-module, a data processing sub-module, and compensation input sub-modules having a same number as that of the light-emitting elements, and each of the compensation input sub-modules is connected to the anode of the corresponding one of the light-emitting elements.

In an embodiment according to the present disclosure, for example, the signal input sub-module is connected to the data processing sub-module, the voltage storage sub-module and the compensation input sub-modules, and the signal input sub-module is configured to provide a temperature detection signal outputted by the data processing sub-module to the voltage storage sub-module during the pre-set detection period, and to provide a temperature compensation voltage output by the data processing sub-module to the compensation input sub-modules when the respective light-emitting devices emits light;

the voltage storage sub-module is further connected to a ground end, and is configured to be charged or discharged under a control of the ground end and the temperature detection signal as received;

the data processing sub-module is further connected to the voltage storage sub-module, and is configured to: output the temperature detection signal, to detect a discharge time of the voltage storage sub-module when the voltage storage sub-module is discharged, to determine the temperature of the organic light-emitting display panel according to the discharge time as detected, to determine the temperature compensation voltage corresponding to the organic light-emitting display panel according to the temperature as detected when it is determined that the temperature of the organic light-emitting display panel is not within the pre-set temperature range, and to apply the temperature compensation voltage as determined to the anodes of the respective light-emitting elements through the compensation sub-modules corresponding to the respective light-emitting elements;

each of the compensation input sub-modules is configured to input the temperature compensation voltage as detected to the anode of the light-emitting element connected therewith when the light-emitting element connected therewith emits light.

In an embodiment according to the present disclosure, for example, the signal input sub-module, the voltage storage sub-module, and the compensation input sub-modules are located in a display region of the organic light-emitting display panel.

In an embodiment according to the present disclosure, for example, the display region comprises a plurality of pixel units, one voltage storage sub-module and one signal input sub-module, each of the pixel units comprises one light-emitting element and one compensation input sub-module.

In an embodiment according to the present disclosure, for example, the data processing sub-module is configured to detect a discharge time of the voltage storage sub-module when the voltage storage sub-module is discharged, to determine a temperature of the display region according to the discharge time as detected, to determine a temperature compensation voltage corresponding to the display region according to the temperature as detected when it is determined that the temperature of the display region is not within the pre-set temperature range, and to apply the temperature compensation voltage as determined to the anodes of the respective light-emitting elements through the compensation input sub-modules corresponding to the respective light-emitting elements.

In an embodiment according to the present disclosure, for example, the display region comprises a plurality of display sub-regions, each of the display sub-regions comprises: at least one pixel unit, one voltage storage sub-module, and one signal input a sub-module; each pixel unit comprises one light-emitting element and one compensation input sub-module.

In an embodiment according to the present disclosure, for example, the data processing sub-module is configured to detect a discharge time of the voltage storage sub-module in the respective display sub-regions when the voltage storage sub-module in the respective display sub-regions is discharged, to determine a temperature corresponding to each of the display sub-regions according to the discharge time as detected of each of the voltage storage sub-module, to determine a temperature compensation voltage corresponding to the respective display sub-regions according to the temperature corresponding to each of the display sub-regions when it is determined that the temperature as detected of each of the display sub-pixels is not within the pre-set temperature range, and to supply the temperature compensation voltage as determined to the anodes of the respective light-emitting element through the compensation input sub-modules corresponding to the respective light-emitting elements.

In an embodiment according to the present disclosure, for example, the signal input sub-module includes: a first switching transistor, wherein a control electrode of the first switching transistor is connected to an input control signal terminal, a first electrode of the first switching transistor is connected with the data processing sub-module, and a second electrode of the first switching transistor is connected to the voltage storage sub-module and the compensation input sub-modules.

In an embodiment according to the present disclosure, for example, each of the compensation input sub-module includes: a second switching transistor; wherein a control electrode of the second switching transistor is connected to a compensation control signal terminal, a first electrode of the second switching transistor is connected to the signal input sub-module, and a second electrode of the second switching transistor is connected to the anode of the corresponding one of the light-emitting elements.

In an embodiment according to the present disclosure, for example, the voltage storage sub-module includes: a first capacitor; wherein a first end of the first capacitor is connected to the signal input sub-module and the data processing sub-module, and a second end of the first capacitor is connected to a ground end.

Embodiments of the present disclosure further provides a display method for the above-described organic light-emitting display panel, the organic light-emitting display panel including a plurality of light-emitting elements, wherein the display method includes:

detecting a temperature of the organic light-emitting display panel during a pre-set detection period;

when the temperature of the organic light-emitting display panel is not within a pre-set temperature range, determining a temperature compensation voltage corresponding to the organic light-emitting display panel according to the temperature detected by the temperature detection and compensation module; and supplying the temperature compensation voltage as determined to anodes of the light-emitting elements when the light-emitting elements emit light.

In an embodiment according to the present disclosure, in the abovementioned display method, for example, detecting the temperature of the organic light-emitting display panel during the pre-set detection period includes: supplying a temperature detection signal to the voltage storage sub-module during the pre-set detection period to charge and discharge the voltage storage sub-module; detecting a discharge time of the voltage storage sub-module when the voltage storage sub-module is discharged; and determining the temperature of the organic light-emitting display panel according to the discharge time as detected.

In an embodiment according to the present disclosure, in the abovementioned display method, supplying the temperature compensation voltage as determined to the anodes of the plurality of light-emitting elements includes: supplying the temperature compensation voltage as determined to the anodes of the light-emitting elements that are emitting light through the compensation input sub-modules corresponding to the light-emitting elements that are emitting light.

BRIEF DESCRIPTION OF THE DRAWINGS

In order to clearly illustrate the technical solution of embodiments of the present disclosure, the drawings of the embodiments will be briefly described in the following, it is obvious that the drawings in the description are only related to some embodiments of the present disclosure and not limited to the present disclosure.

DETAILED DESCRIPTION

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Figure 1:
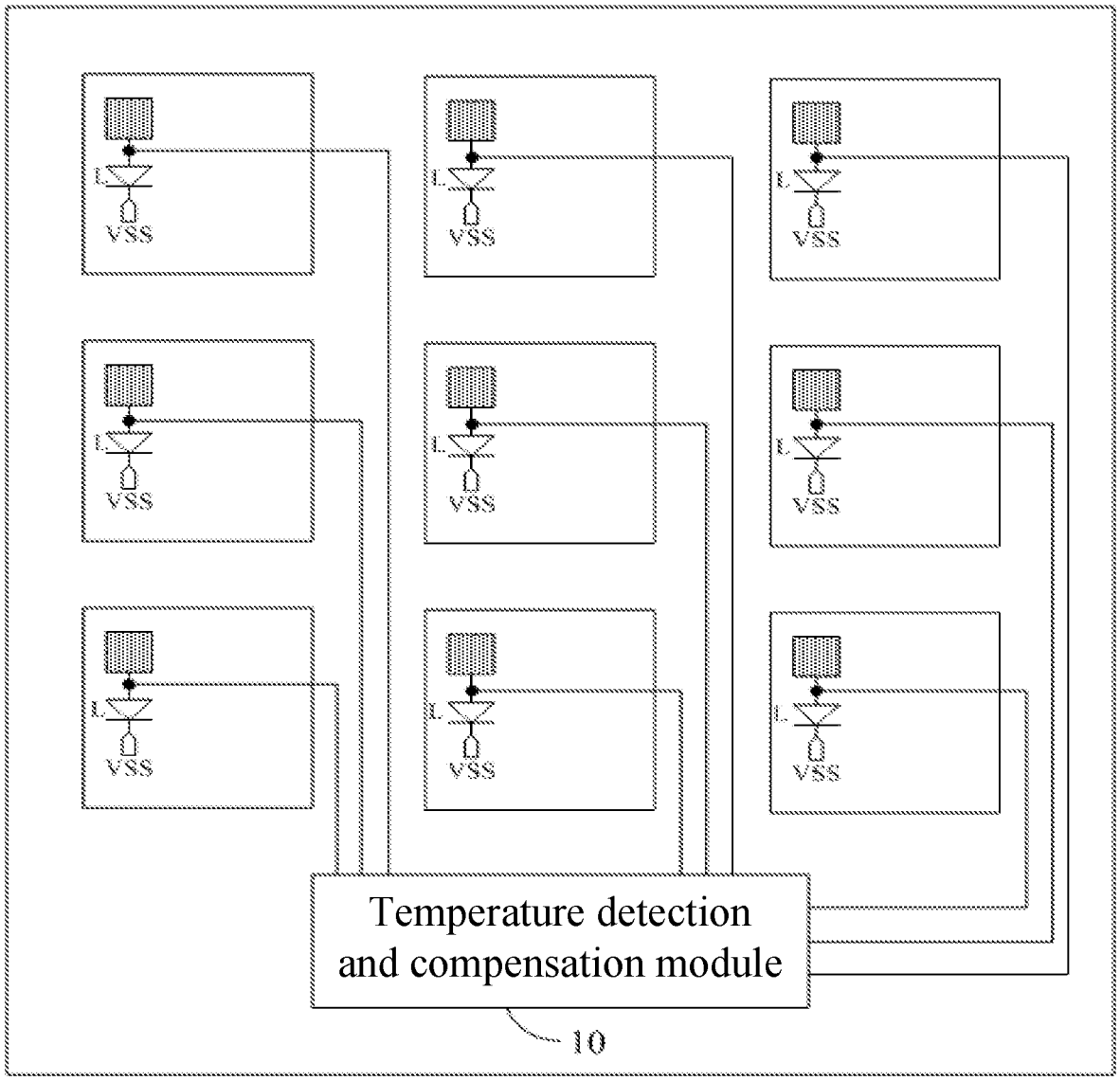
FIG. 1 is a first schematic structural diagram of an organic light-emitting display panel provided by an embodiment of the present disclosure.

An embodiment of the present disclosure provides an organic light-emitting display panel. As illustrated by FIG. 1 to FIG. 2*c*, the organic light-emitting display panel includes a plurality of light-emitting elements L. The organic light-emitting display panel further includes: a temperature detection and compensation module 10 electrically connected to anodes of the respective light-emitting elements L.

The temperature detection and compensation module 10 is configured to detect a temperature of the organic light-emitting display panel within a pre-set detection period, determine a temperature compensation voltage corresponding to the organic light-emitting display according to the temperature detected by the temperature detection and compensation module 10 when it is determined that the temperature of the organic light-emitting display panel is not within the pre-set temperature range, and apply the temperature compensation voltage as determined to the anodes of the plurality of light-emitting elements L when the plurality of light-emitting elements L emits light.

In the abovementioned organic light-emitting display panel provided by the embodiment of the present disclosure, the temperature detection and compensation module as arranged is configured to detect the temperature of the organic light-emitting display panel during the pre-set detection period, determine a temperature compensation voltage corresponding to the organic light-emitting display according to the temperature as detected of the organic light-emitting display panel when it is determined that the temperature of the organic light-emitting display panel is not within the pre-set temperature range, and finally apply the temperature compensation voltage as determined to the anodes of the plurality of light-emitting elements L when the plurality of light-emitting elements L emit light, so as to carry out voltage compensation on anode voltage of the plurality of light-emitting elements, so that color-bias phenomenon exhibited by the light-emitting elements caused by temperature variation can be eliminated, thereby improving the display effect of the organic light-emitting display panel.

For example, in the abovementioned organic light-emitting display panel provided by the embodiment of the present disclosure, the pre-set temperature range can be 26.9° C. to 27.1° C., or 26° C. to 28° C. Certainly, the pre-set temperature range can be determined according to the actual application environment.

For example, in the abovementioned organic light-emitting display panel provided by the embodiment of the present disclosure, the pre-set detection period can be a time interval of M display frames, wherein M is an integer greater than or equal to 1. For example, the pre-set detection period can be a time interval of one display frame, so that the temperature of the organic light-emitting display panel can be accurately acquired. Alternatively, the pre-set detection period can be a time interval of five display frames, so that power consumption of the organic light-emitting display panel can be reduced. The pre-set detection period can be determined according to the actual application environment.

For example, in the abovementioned organic light-emitting display panel provided by the embodiment of the present disclosure, the respective light-emitting elements are electrically connected to the temperature detection and compensation module through wires in one-to-one correspondence.

For example, in the abovementioned organic light-emitting display panel provided by the embodiment of the present disclosure, the temperature detection and compensation module is further configured to not perform voltage compensation to the respective light-emitting elements when it is determined that the temperature of the organic light-emitting display panel is within the pre-set temperature range.

Figure 2A:
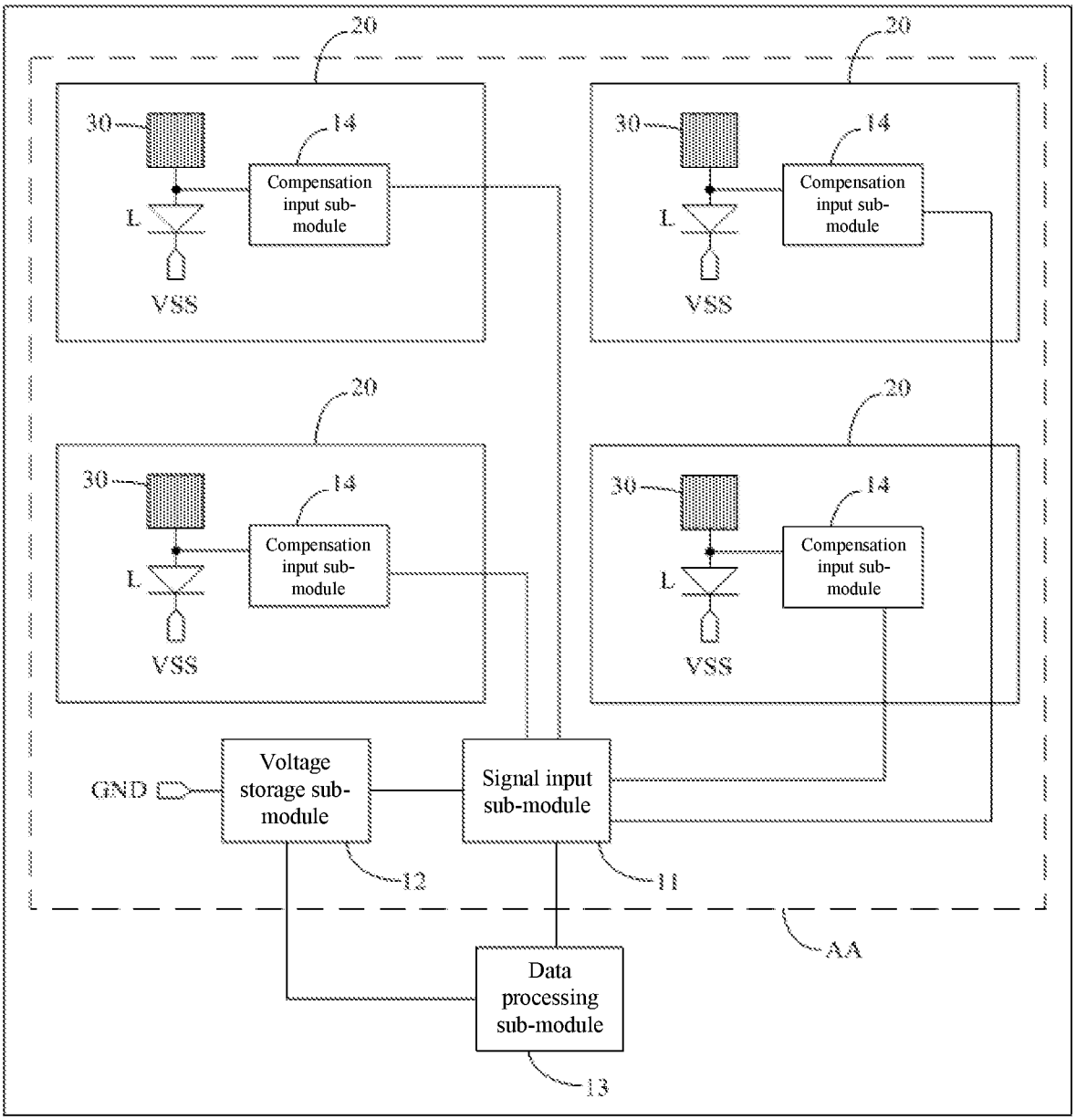
FIG. 2*a* is a second schematic structural diagram of an organic light-emitting display panel provided by an embodiment of the present disclosure.
Figure 2B:
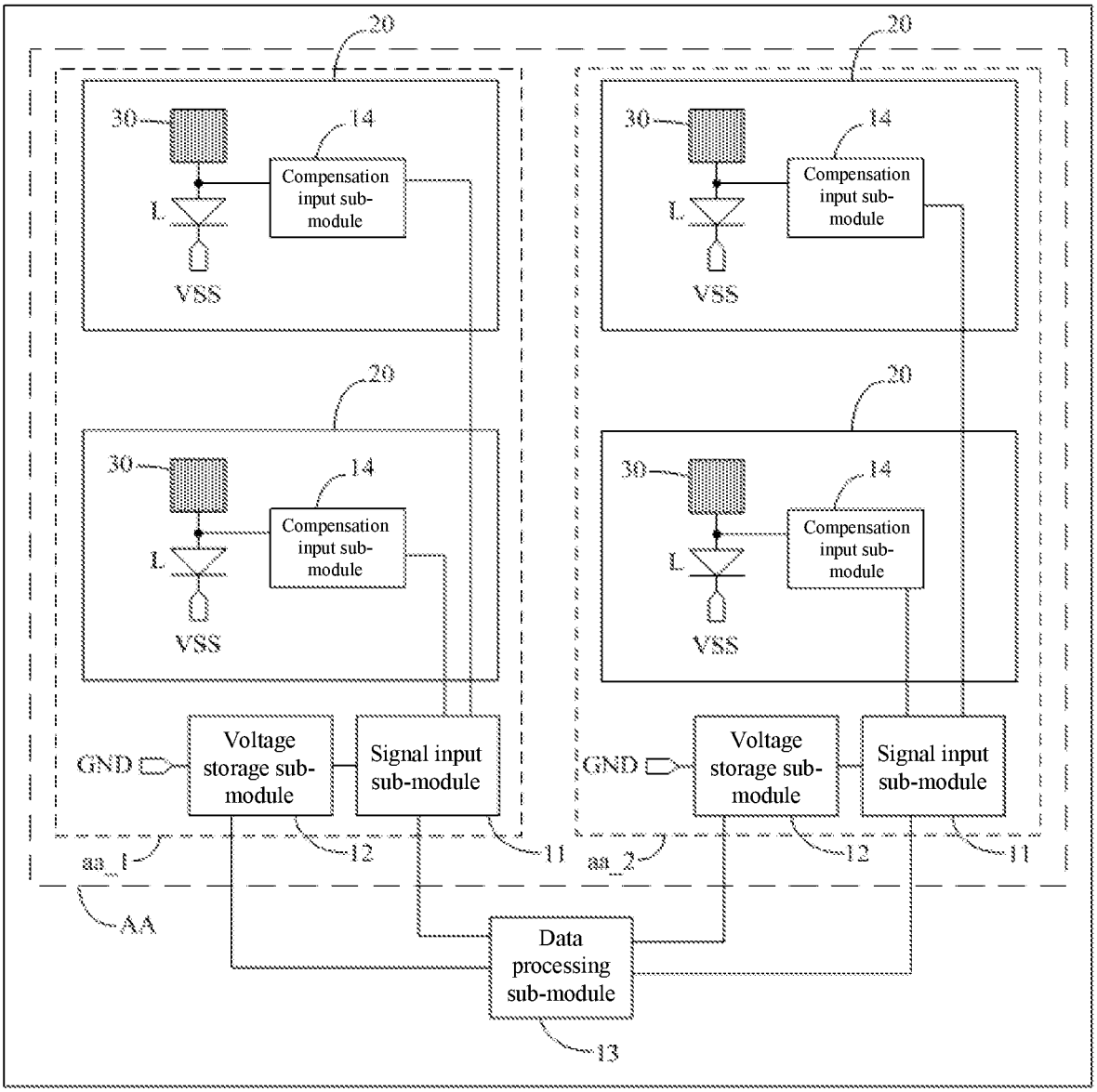
FIG. 2*b* is a third schematic structural diagram of an organic light-emitting display panel provided by an embodiment of the present disclosure.
Figure 2C:
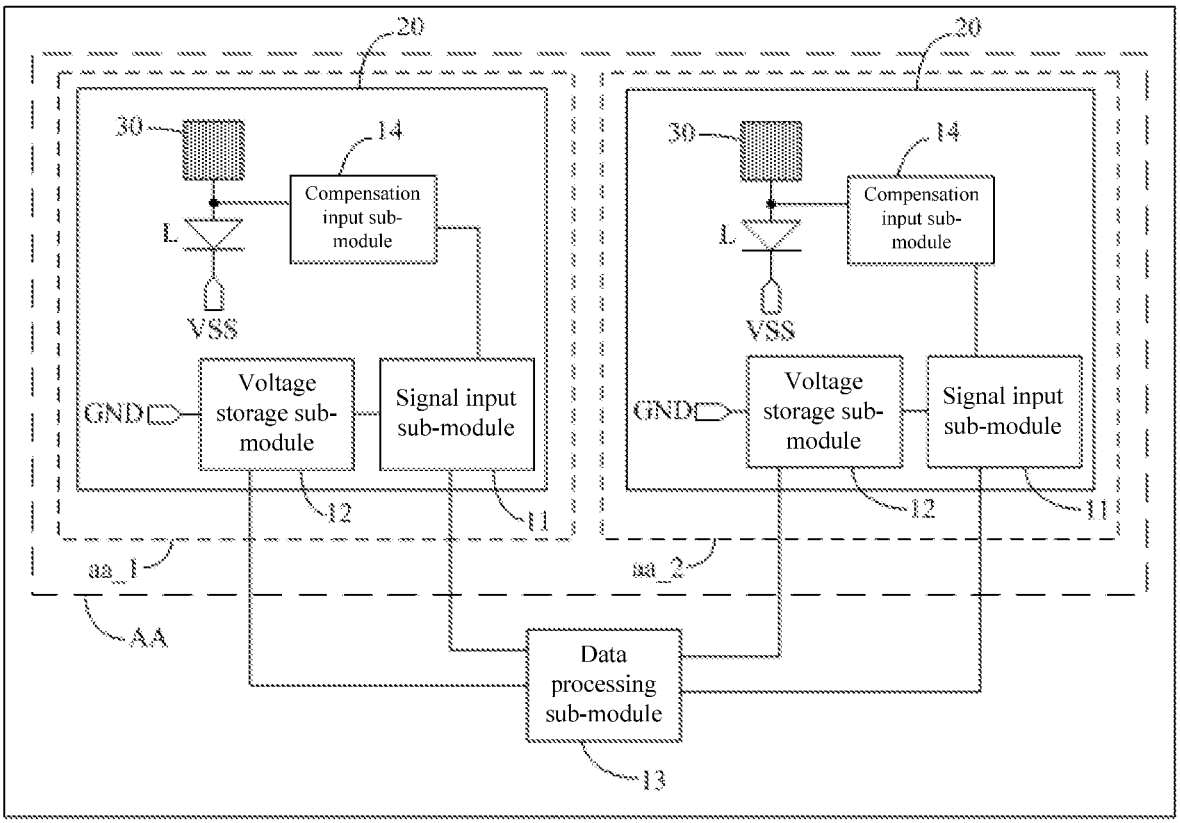
FIG. 2*c* is a fourth schematic structural diagram of an organic light-emitting display panel provided by an embodiment of the present disclosure.

For example, in the abovementioned organic light-emitting display panel provided by the embodiment of the present disclosure, as illustrated by FIG. 2*a* to FIG. 2*c*, the temperature detection and compensation module can include: a signal input sub-module 11, a voltage storage sub-module 12, a data processing sub-module 13 and a plurality of compensation input sub-modules 14 having the same number as that of the plurality of light-emitting elements L, and each of the plurality of compensation input sub-modules 14 is connected to the anode of the corresponding one of the plurality of light-emitting elements L;

The signal input sub-module 11 is respectively connected to the data processing sub-module 13, the voltage storage sub-module 12 and the plurality of compensation input sub-modules 14; the signal input sub-module is configured to supply a temperature detection signal outputted by the data processing sub-module 13 to the voltage storage sub-module 12 within the pre-set detection period, and to supply the temperature compensation voltage outputted by the data processing sub-module 13 to the plurality of compensation input sub-modules 14 when the plurality of light-emitting elements L emit light.

The voltage storage sub-module 12 is further connected to a ground end GND, and is charged or discharged under the control of the ground end GND and the temperature detection signal as received;

The data processing sub-module 13 is further connected to the voltage storage sub-module 12 to output the temperature detection signal; upon the voltage storage sub-module 12 being discharged, the data processing sub-module 13 detects a discharge time of the voltage storage sub-module 12, determines a temperature compensation voltage corresponding to the organic light-emitting display panel according to the discharge time as detected when it is determined that the temperature of the organic light-emitting display panel is not within the pre-set temperature range, and apply the temperature compensation voltage as determined to the anodes of the plurality of light-emitting elements L through the compensation input sub-modules L corresponding to the light-emitting elements L according to the temperature compensation voltage as determined;

The respective compensation input sub-modules 14 are configured to input the temperature compensation voltage as determined to the anodes of the abovementioned light-emitting elements L when the light-emitting elements connected with the compensation input sub modules 14 emit light.

The temperature detection and compensation module of the abovementioned organic light-emitting display panel provided by the embodiment of the present disclosure includes: a signal input sub-module, a voltage storage sub-module, a data processing sub-module, and a plurality of compensation input sub-modules connected with the anodes of the light-emitting elements in one-to-one correspondence. by mutual interaction of these sub-modules, the anode voltage of each of the light-emitting elements is compensated when the temperature of the organic light-emitting display panel is not within the pre-set temperature range, so as to eliminate the color-bias of the light-emitting elements caused by temperature variation, so as to further improve the display effect of the organic light-emitting display panel.

Generally, a display panel includes a display region and a non-display region. In order to better compensate the light-emitting elements, for example, in the abovementioned organic light-emitting display panel provided by the embodiment of the present disclosure, as illustrated by FIG. 2*a* to FIG. 2*c*, the signal input sub-module 11, the voltage storage sub module 12 and the compensation input sub modules 14 are located in the display region AA of the organic light-emitting display panel. Because the temperature of the display region AA is very close to the temperature of environment where the light-emitting elements L are located, the voltage compensation to the light-emitting elements L can be more accurately. Certainly, the abovementioned sub-modules can also be disposed in the non-display region. The locations of the abovementioned sub-modules can be determined according to the actual application environment.

For example, in the abovementioned organic light-emitting display panel provided by the embodiment of the present disclosure, as illustrated by FIG. 2*a* to FIG. 2*c*, the organic light-emitting display panel further includes: a plurality of pixel compensation circuits 30 having the same number as that of the plurality of light-emitting elements L, and each of the pixel compensation circuits 30 is connected to the anode of the corresponding one of light-emitting elements L.

For example, in the abovementioned organic light-emitting display panel provided by the embodiment of the present disclosure, when the signal input sub-module, the voltage storage sub-module, and the compensation input sub-modules are located in a display region of the organic light-emitting display panel, orthographic projections of the signal input sub-module and the voltage storage device and the compensation input sub-modules on the organic light-emitting display panel can be located within orthographic projection of the pixel compensation circuit on the organic light-emitting display panel. The positions of the signal input sub-module, the voltage storage sub-module, and the compensation input sub-modules in the display region of the organic light-emitting display panel can be determined or designed according to the actual application environment.

For example, in the abovementioned organic light-emitting display panel provided by the embodiment of the present disclosure, the data processing sub-module can be located in the display region of the organic light-emitting display panel, can be located in the non-display region of the organic light-emitting display panel, can be located on a printed circuit board of the organic light-emitting display panel, or can be located on a flexible circuit board of the organic light-emitting display panel. The specific location of the data processing sub-module can be determined according to the actual application environment.

The display region of the small-sized organic light-emitting display panel is relatively small, and thus the temperature in the display region can be relatively uniform. For example, in the abovementioned organic light-emitting display panel provided by the embodiment of the present disclosure, as illustrated by FIG. 2*a*, the display region AA includes a plurality of pixel units 20, a voltage storage sub-module 12, and a signal input sub-module 11, and each of the pixel unit 20 includes a light-emitting element L and a compensation input sub-module 14.

The data processing sub-module 13 is configured to detect a discharge time of the voltage storage sub-module 12 when it is discharged, to determine a temperature compensation voltage corresponding to the display region AA according to the discharge time as detected when it is determined that the temperature of the display region AA is not within the pre-set temperature range, and to supply the temperature compensation voltage to the anodes of the light-emitting elements through the compensation input sub-modules 14 corresponding to the light-emitting elements L according to the temperature compensation voltage as determined.

The display region of the large-sized or medium-sized organic light-emitting display panel is relatively large, and thus the temperature in the display region may be uneven. For example, in the abovementioned organic light-emitting display panel provided by the embodiment of the present disclosure, as illustrated by FIG. 2*b* and FIG. 2*c*, the display region AA is divided into a plurality of display sub-regions aa_n (n=1, 2, 3 . . . N, N is a positive integer), and each display sub-region aa_n can include: at least one pixel unit 20 (each display sub-region in FIG. 2*b* includes two pixel units, and each display sub-region in FIG. 2*c* includes one pixel unit), one voltage storage sub-module 12 and one signal input sub-module 11; each pixel unit 20 includes one light-emitting element L and one compensation input sub-module 14;

The data processing sub-module 13 is configured to detect a discharge time of the voltage storage sub-module 12 in each display sub-region aa_n upon the voltage storage sub-module 12 in each display sub-region aa_n being discharged; and to determine a temperature corresponding to each display sub-region aa_n according to the discharge time as detected of the voltage storage sub-module 12; For each display sub-region aa_n, when it is determined that the temperature of the display sub-region aa_n is not within the pre-set temperature range, the data processing sub-module 13 is further configured to determine a temperature compensation voltage corresponding to the display sub-region aa_n according to the corresponding temperature of the display sub-region aa_n, and to supply the temperature compensation voltage as determined to anodes of the light-emitting elements L through the compensation input sub-modules 14 corresponding to the light-emitting elements L according to the temperature compensation voltage as determined.

Figure 3:
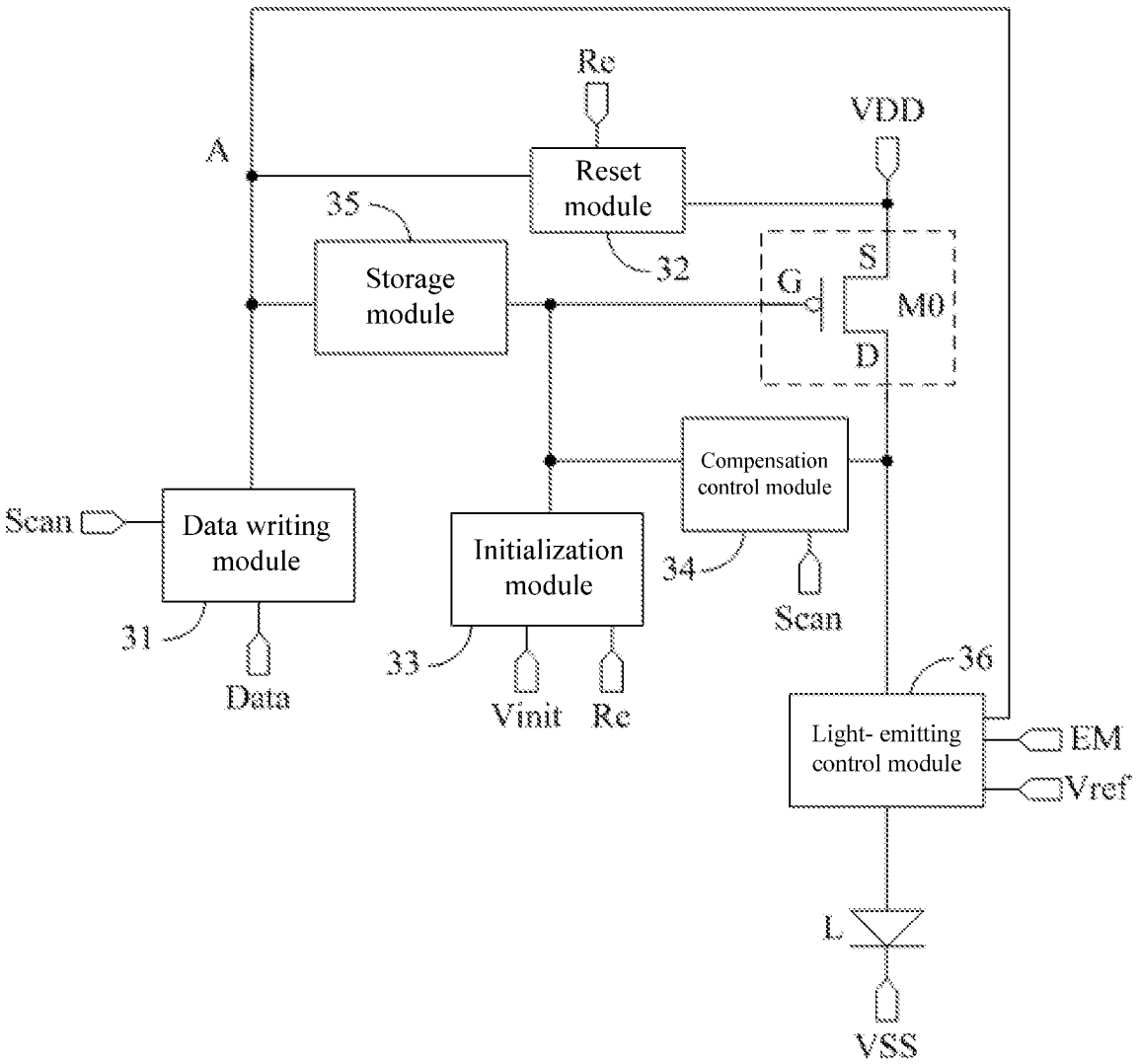
FIG. 3 is a schematic structural diagram of a pixel compensation circuit provided by an embodiment of the present disclosure.

For example, in the abovementioned organic light-emitting display panel provided by the embodiment of the present disclosure, as illustrated by FIG. 3, the pixel compensation circuit can include: a data writing module 31, a reset module 32, an initialization module 33, a compensation control module 34, a storage module 35, a light-emitting control module 36, and a driving transistor M0; wherein a first electrode S of the driving transistor M0 is connected to a first power terminal VDD, and a second electrode D of the driving transistor M0 is connected to the anode of the corresponding one of the light-emitting elements L.

The data writing module 31 is respectively connected to a scanning signal terminal Scan, a data signal terminal Data, and a first node A, and configured to supply a signal from the data signal terminal Data to the first node A under the control of the scanning signal terminal Scan.

The reset module 32 is respectively connected to a reset signal terminal Re, the first power terminal VDD, and the first node A. The reset module 32 supplies a signal from the first power terminal VDD to the first node A under the control of the reset signal terminal Re.

The initialization module 33 is connected to the reset signal terminal Re, an initialization signal terminal Vinit, and a control electrode G of the driving transistor M0. The initialization module 33 supplies a signal from the initialization signal terminal Vinit to the gate electrode G of the driving transistor M0 under the control of the reset signal terminal Re.

The compensation control module 34 is connected to the scan signal terminal Scan, the control electrode G of the driving transistor M0, and the second electrode D of the driving transistor M0, respectively. The compensation control module 34 conducts the gate electrode G and the second electrode D of the driving transistor M0 under the control of the scanning signal terminal Scan.

The memory module 35 is respectively connected to the first node A and the gate electrode G of the driving transistor M0. The memory module 35 is charged or discharged under the control of the signal of the first node A and the signal of the gate electrode G of the driving transistor M0, and maintains a stable voltage difference between the first node A and the control electrode G of the driving transistor M0 upon the control electrode G of the driving transistor M0 being in the floating state.

The light-emitting control module 36 is respectively connected to an light-emitting control signal terminal EM, an reference signal terminal Vref, the first node A, the second electrode D of the driving transistor M0, and the anode of the light-emitting element L; a cathode of the light-emitting element L is connected to a second power terminal VSS. The light-emitting control module 36 supplies the signal from the reference signal terminal Vref to the first node A under the control of the light-emitting control signal terminal EM, and conducts the second electrode D of the driving transistor M0 and the anode of the light-emitting element L to make the light-emitting element L as connected emit light.

In the abovementioned organic light-emitting display panel provided by the embodiment of the present disclosure, the pixel compensation circuit includes: a data writing module, a reset module, a compensation control module, a memory module, a light-emitting control module, and a driving transistor. By means of the mutual interaction between the modules and the driving transistor, the operating current by which the driving transistor to drive the light-emitting element to emit light is only related to the voltage of the data signal terminal and the voltage of the reference signal terminal, irrespective of the threshold voltage of the driving transistor and the voltage of the first power terminal, so that the influence of the threshold voltage and IR Drop of the driving transistor on the operation current flowing through the light-emitting element can be eliminated, so as to stabilize the operating current for driving the light-emitting element to emit light, thereby improving the uniformity of the brightness of the display region of the organic light-emitting display panel. The foregoing is only an example for describing the structure of the pixel compensation circuit provided by the embodiment of the present disclosure. The structure of the pixel compensation circuit is not limited to the abovementioned structure provided by the embodiment of the present disclosure, and can be other structures, which are not limited herein.

For example, in the abovementioned pixel compensation circuit provided by the embodiment of the present disclosure, during the time that the temperature detection and compensation module detects the temperature of the organic light-emitting display panel, the pixel compensation circuit can be controlled to drive the light-emitting element as connected to emit light, or not work, i.e., not drive the light-emitting element as connected to emit light. The working state of the pixel compensation circuit can be determined or designed according to the actual application environment.

For example, in the abovementioned pixel compensation circuit provided by the embodiment of the present disclosure, as illustrated by FIG. 3, the driving transistor M0 can be a P-type transistor. A gate electrode of the P-type transistor is the control electrode G of the driving transistor M0, a source electrode of the P-type transistor is the first electrode S of the driving transistor M0, and a drain electrode of the P-type transistor is the second electrode D of the driving transistor M0. Current flows from the first electrode S of the driving transistor M0 to the second electrode D of the driving transistor M0. In order to ensure that the driving transistor M0 can work normally, the voltage Vdd of the corresponding first power terminal is generally positive, and the voltage Vss of the second power terminal is generally grounded or negative. Hereinafter, a case where the voltage Vss of the second power supply terminal is grounded will be described as an example.

For example, in the abovementioned pixel compensation circuit provided by the embodiment of the present disclosure, the driving transistor can also be an N-type transistor. A gate electrode of the N-type transistor is the control electrode of the driving transistor, a drain electrode of the N-type transistor is the first electrode of the driving transistor, and a source electrode of the N-type transistor is the second electrode of the driving transistor. Current flows from the first electrode of the driving transistor to the second electrode of the driving transistor.

For example, in the abovementioned organic light-emitting display panel provided by the embodiment of the present disclosure, the light-emitting element is generally an organic electroluminescent diode that emits light under the action of current upon the driving transistor is in a saturated state.

For example, the abovementioned organic light-emitting display panel provided by the embodiment of the present disclosure can be any product or component having a display function, such as a mobile phone, a tablet computer, a television, a display, a notebook computer, a digital photo frame, a navigator, and the like. It is understood by those skilled in the art that other indispensable components of the organic light-emitting display panel are included, which are not repeated herein; and the present disclosure should not be limited thereto.

Hereinafter, the present disclosure will be described in detail with reference to specific embodiments by taking a case where each of the display sub-regions includes a pixel unit, a voltage storage sub-module and a signal input sub-module as an example. It should be noted that the present embodiment is intended to better explain the present disclosure, but does not limit the present disclosure.

Figure 4A:
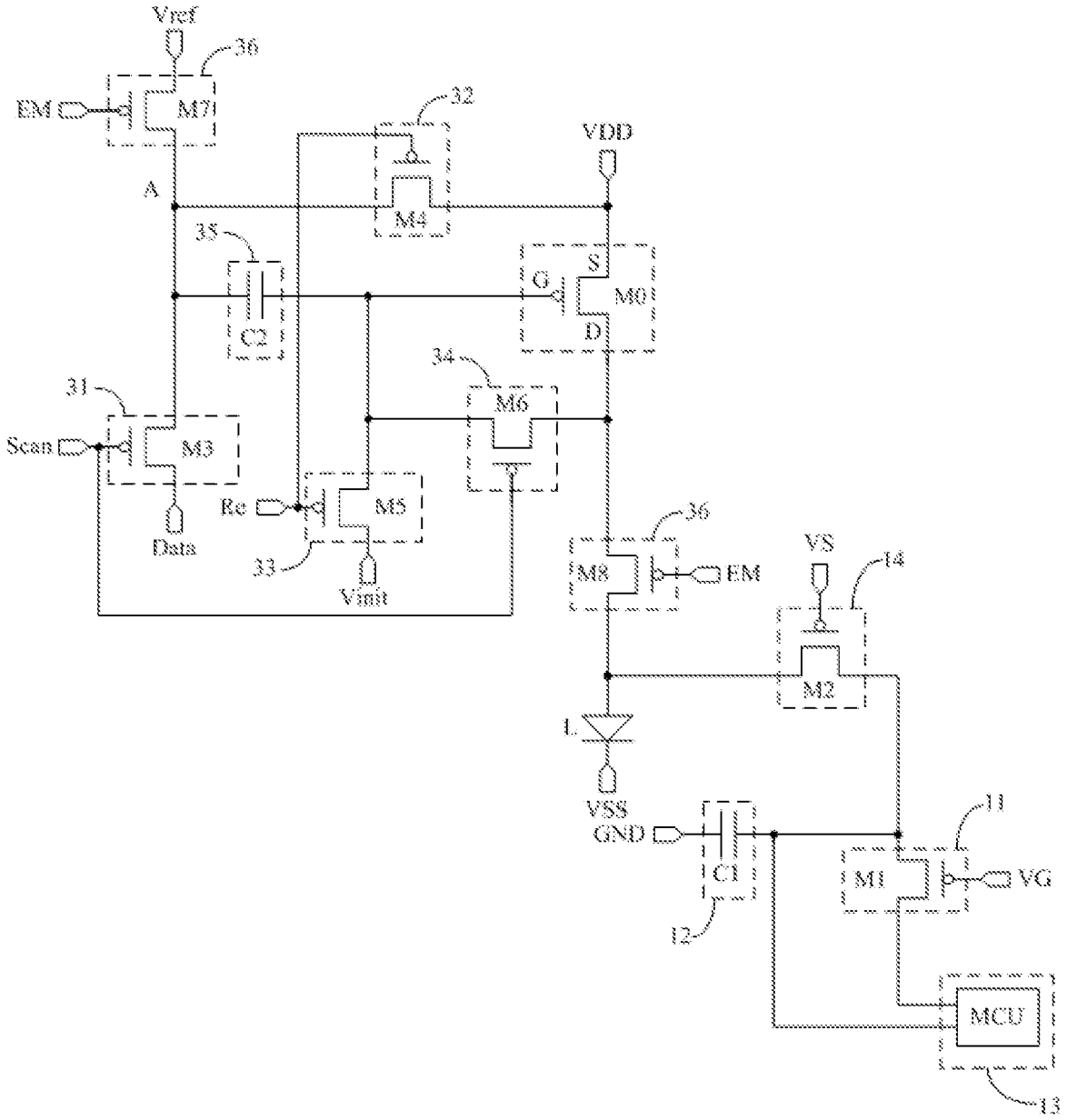
FIG. 4*a* is a first schematic structural diagram of an organic light-emitting display panel provided by an embodiment of the present disclosure.
Figure 4B:
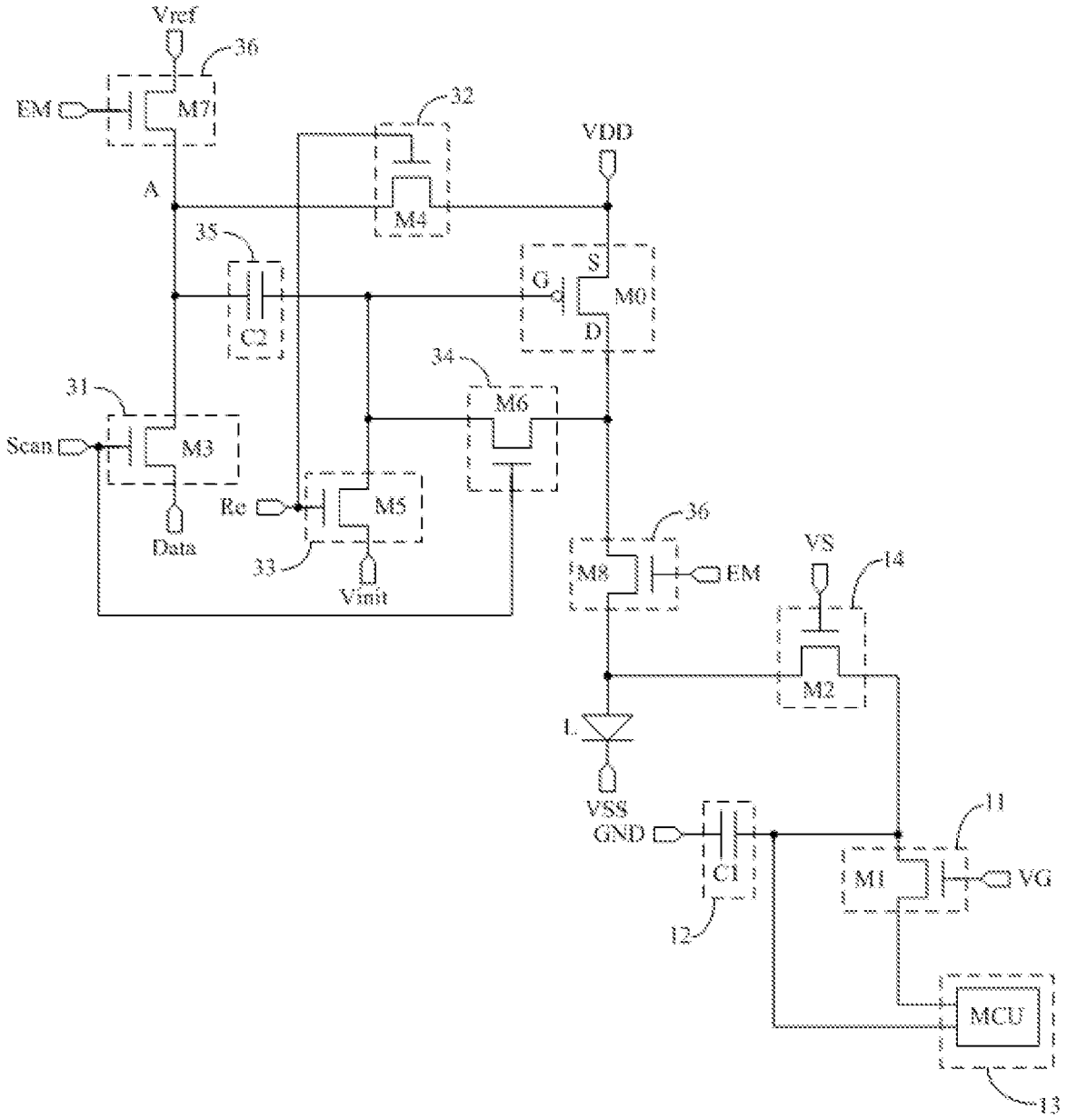
FIG. 4*b* is a second schematic structural diagram of an organic light-emitting display panel provided by an embodiment of the present disclosure.

For example, in the abovementioned organic light-emitting display panel provided by the embodiment of the present disclosure, as illustrated by FIG. 4*a* and FIG. 4*b*, the signal input sub-module 11 can include: a first switching transistor M1;

A control electrode of the first switching transistor M1 is connected to an input control signal terminal VG; a first electrode of the first switching transistor M1 is connected to a data processing sub-module 13; and a second electrode of the first switching transistor M1 is connected to a voltage storage sub-module 12 and a compensation input sub-module 14, respectively.

For example, in the abovementioned organic light-emitting display panel provided by the embodiment of the present disclosure, as illustrated by FIG. 4*a*, the first switching transistor M1 can be a P-type transistor; or, as illustrated by FIG. 4*b*, the first switching transistor M1 may also be N-type transistor. The specific structure of the first switching transistor can be determined according to the actual application environment, and is not limited herein.

For example, in the abovementioned organic light-emitting display panel provided by the embodiment of the present disclosure, upon the first switching transistor being in an on state under the control of the input control signal terminal, a temperature detection signal outputted by the data processing sub-module is supplied to the voltage storage sub-module; upon the first switching transistor being in an off state under the control of the input control signal terminal, a voltage of signal inputted to the control signal terminal is set to cause the first switching transistor to generate a leakage current phenomenon; and upon the first switching transistor being in an on state under the control of the input control signal terminal, a temperature compensation voltage outputted by the data processing sub-module is supplied to the compensation input sub-module.

For example, in the abovementioned organic light-emitting display panel provided by the embodiment of the present disclosure, as illustrated by FIG. 4*a* and FIG. 4*b*, the compensation input sub-module 14 can include: a second switching transistor M2;

A control electrode of the second switching transistor M2 is connected to the compensation control signal terminal VS, a first electrode of the second switching transistor M2 is connected to the signal input sub-module 11, and a second electrode of the second switching transistor M2 is connected to the anode of the corresponding one of the light-emitting elements L.

For example, in the abovementioned organic light-emitting display panel provided by the embodiment of the present disclosure, as illustrated by FIG. 4*a*, the second switching transistor M2 can be a P-type transistor; or, as illustrated by FIG. 4*b*, the second switching transistor M2 may also be N-type transistor. The structure of the second switching transistor can be determined and designed according to the actual application environment, which is not limited herein.

For example, in the abovementioned organic light-emitting display panel provided by the embodiment of the present disclosure, upon the second switching transistor being in an on state under the control of the compensation control signal terminal, the corresponding temperature compensation voltage outputted by the signal input sub-module is applied to the anode of the corresponding one of the light-emitting elements.

For example, in the abovementioned organic light-emitting display panel provided by the embodiment of the present disclosure, as illustrated by FIG. 4*a* and FIG. 4*b*, the voltage storage sub-module 12 can include: a first capacitor C1;

A first end of the first capacitor C1 is connected to the signal input sub-module 11 and the data processing sub-module 13, respectively, and the second end is connected to the ground end GND.

For example, in the abovementioned organic light-emitting display panel provided by the embodiment of the present disclosure, the first capacitor is charged under the control of the temperature detection signal, and the voltage after the completion of the charging of the first capacitor is $V_0$; and then the voltage of the signal inputted to the control signal terminal is set to cause the first switching transistor to generate leakage current, so that the first capacitor is discharged through the first switching transistor, and the voltage after the completion of the discharging is $V_t$; and a time taken for the first capacitor to discharge from $V_0$ to $V_t$ is a discharging time. According to the characteristics that semiconductor material of an active layer of the switching transistor changes with temperature, that is, leakage current of the active layer of the first switching transistor increases with temperature, so that the discharging times of the first capacitor at different temperatures are different.

For example, in the abovementioned organic light-emitting display panel provided by the embodiment of the present disclosure, as illustrated by FIG. 4*a* and FIG. 4*b*, the data processing sub-module 13 can include a microprocessor MCU;

An output terminal of the microprocessor MCU is connected to the signal input sub-module 11 and a receiving terminal of the microprocessor MCU is connected to the voltage storage sub-module 12.

For example, in the abovementioned organic light-emitting display panel provided by the embodiment of the present disclosure, the microprocessor can be a chip circuit that combines a software program and hardware. And the structure of the microprocessor can employ conventional techniques, and will not be repeated herein.

For example, in the abovementioned organic light-emitting display panel provided by the embodiment of the present disclosure, as illustrated by FIG. 4*a* and FIG. 4*b*, the data writing module 31 can include: a third switching transistor M3;

A control electrode of the third switching transistor M3 is connected to a scanning signal terminal Scan, a first electrode of the third switching transistor M3 is connected to a data signal terminal Data, and a second electrode of the third switching transistor M3 is connected to the first node A.

For example, in the abovementioned organic light-emitting display panel provided by the embodiment of the present disclosure, as illustrated by FIG. 4*a*, the third switching transistor M3 can be a P-type transistor; or, as illustrated by FIG. 4*b*, the third switching transistor M3 may also be a N-type transistor. The structure of the third switching transistor can be determined and designed according to the actual application environment, which is not limited herein.

For example, in the abovementioned organic light-emitting display panel provided by the embodiment of the present disclosure, upon the third switching transistor being in an on state under the control of signal of the scanning signal terminal, the signal from the data signal terminal is supplied to the first node.

For example, in the abovementioned organic light-emitting display panel provided by the embodiment of the present disclosure, as illustrated by FIG. 4*a* and FIG. 4*b*, the reset module 32 can include: a fourth switching transistor M4;

A control electrode of the fourth switching transistor M4 is connected to a reset signal terminal Re, a first electrode of the fourth switching transistor M4 is connected to a first power terminal VDD, and a second electrode of the fourth switching transistor M4 is connected to the first node A.

For example, in the abovementioned organic light-emitting display panel provided by the embodiment of the present disclosure, as illustrated by FIG. 4*a*, the fourth switching transistor M4 can be a P-type transistor, or, as illustrated by FIG. 4*b*, the fourth switching transistor M4 may also be a N-type transistor. The structure of the fourth switching transistor can be determined and designed according to the actual application environment, which is not limited herein.

For example, in the abovementioned organic light-emitting display panel provided by the embodiment of the present disclosure, upon the fourth switching transistor being in an on state under the control of the signal of the reset signal terminal, the signal from the first power terminal is supplied to the first node.

For example, in the abovementioned organic light-emitting display panel provided by the embodiment of the present disclosure, as illustrated by FIG. 4*a* and FIG. 4*b*, the initialization module 33 can include: a fifth switching transistor M5;

A control electrode of the fifth switching transistor M5 is connected to the reset signal terminal Re, a first electrode of the fifth switching transistor M5 is connected to the initialization signal terminal Vinit, and a second electrode of the fifth switching transistor M5 is connected to the control electrode G of the driving transistor M0.

For example, in the abovementioned organic light-emitting display panel provided by the embodiment of the present disclosure, as illustrated by FIG. 4*a*, the fifth switching transistor M5 can be a P-type transistor, or, as illustrated by FIG. 4*b*, the fifth switching transistor M5 may also be a N-type transistor. The structure of the fifth switching transistor can be determined and designed according to the actual application environment, which is not limited herein.

For example, in the abovementioned organic light-emitting display panel provided by the embodiment of the present disclosure, upon the fifth switching transistor being in an on state under the control of the signal of the reset signal terminal, a signal from the initialization signal terminal is supplied to the control electrode of the driving transistor.

For example, in the abovementioned organic light-emitting display panel provided by the embodiment of the present disclosure, as illustrated by FIG. 4*a* and FIG. 4*b*, the compensation control module 34 can include: a sixth switching transistor M6;

A control electrode of the sixth switching transistor M6 is connected to the scanning signal terminal Scan, a first electrode of the sixth switching transistor M6 is connected to the control electrode G of the driving transistor M0, a second electrode of the sixth switching transistor M6 is connected to the second electrode D of the driving transistor M0.

For example, in the abovementioned organic light-emitting display panel provided by the embodiment of the present disclosure, as illustrated by FIG. 4*a*, the sixth switching transistor M6 can be a P-type transistor, or, as illustrated by FIG. 4*b*, the sixth switching transistor M6 can also be a N-type transistor. The structure of the sixth switching transistor can be determined and designed according to the actual application environment, which is not limited herein.

For example, in the abovementioned organic light-emitting display panel provided by the embodiment of the present disclosure, upon the sixth switching transistor being in an on state under the control of the signal of the scanning signal terminal, the control electrode and the second electrode of the driving transistor can be conducted, such that the driving transistor is in a diode connection state.

For example, in the abovementioned organic light-emitting display panel provided by the embodiment of the present disclosure, as illustrated by FIG. 4*a* and FIG. 4*b*, the light-emitting control module 36 can include: a seventh switching transistor M7 and an eighth switching transistor M8;

A control electrode of the seventh switching transistor M7 is connected to the light-emitting control signal terminal EM, a first electrode of the seventh switching transistor M7 is connected to the reference signal terminal Vref, and the second electrode of the seventh switching transistor M7 is connected to the first node A;

A control electrode of the eighth switching transistor M8 is connected to the light-emitting control signal terminal EM, a first electrode of the eighth switching transistor M8 is connected to the second electrode D of the driving transistor M0, and the second electrode of the eighth switching transistor M8 is connected to the anode of the corresponding one of the light-emitting elements.

For example, in the abovementioned organic light-emitting display panel provided by the embodiment of the present disclosure, as illustrated by FIG. 4*a*, the seventh switching transistor M7 and the eighth switching transistor M8 can be P-type transistors; or, as illustrated by FIG. 4*b*, the seventh switch The transistor M7 and the eighth switching transistor M8 may also be N-type transistors. The structure of the seventh switching transistor and the eighth switching transistor can be determined or designed according to the actual application environment, which is not limited herein.

For example, in the abovementioned organic light-emitting display panel provided by the embodiment of the present disclosure, upon the seventh switching transistor being in an on state under the control of the signal of the light-emitting control signal terminal, the reference signal terminal and the first node can be conducted so as to provide the signal from the reference signal terminal to the first node. When the eighth switching transistor is in an on state under the control of the signal of the light-emitting control signal terminal, the second electrode of the driving transistor and the corresponding light-emitting element can be conducted so as to supply the current from the second electrode of the driving transistor to the corresponding light-emitting element to drive the corresponding light-emitting element to emit light.

For example, in the abovementioned organic light-emitting display panel provided by the embodiment of the present disclosure, as illustrated by FIG. 4*a* and FIG. 4*b*, the memory module 35 can include: a second capacitor C2;

A first end of the second capacitor C2 is connected to the first node A, and a second end of the second capacitor C2 is connected to the gate electrode G of the driving transistor M0.

For example, in the abovementioned organic light-emitting display panel provided by the embodiment of the present disclosure, the second capacitor is charged under the control of the signal of the first node and the signal of the control electrode of the driving transistor, and is discharged under the control of the signal of the first node and the signal of the control electrode of the driving transistor. Upon the control electrode of the driving transistor is in a floating state, a voltage difference between the first node and the control electrode of the driving transistor is kept stable.

The forgoing are only examples of the specific structures of the modules in the organic light-emitting display panel provided by the embodiment of the present disclosure. The structures of the abovementioned modules may also have other structures, which are not limited herein.

For example, in the abovementioned organic light-emitting display panel provided by the embodiment of the present disclosure, as illustrated by FIG. 4*a*, all of the switching transistors can be P-type transistors. Or, as illustrated by FIG. 4*b*, all of the switching transistors can be N-type transistors, which are not limited herein.

For example, in the abovementioned organic light-emitting display panel provided by the embodiment of the present disclosure, as illustrated by FIG. 4*a*, in a case where the driving transistor M0 is a P-type transistor, all of the switching transistors are P-type transistors. In this way, the manufacturing processes of the switching transistors in the pixel compensation circuit of the organic light-emitting display panel can be unified, so as to simplify the manufacturing processes.

For example, in the abovementioned organic light-emitting display panel provided by the embodiment of the present disclosure, in a case where the driving transistor is an N-type transistor, all of the switching transistors are N-type transistors. In this way, the manufacturing processes of the switching transistors in the pixel compensation circuit of the organic light-emitting display panel can be unified, so as to simplify the manufacturing processes.

For example, in the abovementioned organic light-emitting display panel provided by the embodiment of the present disclosure, the P-type transistor is turned off under a high potential and turned on under a low potential; the N-type transistor is turned on under a high potential, and is turned off under a low potential.

It should be noted that, in the abovementioned organic light-emitting display panel provided by the embodiment of the present disclosure, the driving transistor and the switching transistors can be thin film transistors (TFTs) or metal oxide semiconductor (MOS) field effect transistors, which is not limited herein. For example, the control electrode of the switching transistor is a gate electrode, according to the types of the switching transistor and the signal of the signal terminals, the first electrode of the switching transistor can be a source electrode or a drain electrode, and the second electrode of the switching transistor can be a drain electrode or a source electrode, which is not limited herein. In the description of the embodiments, a case where the driving transistor and the switching transistors are MOS transistors is described as an example.

A working process of the abovementioned organic light-emitting display panel provided by the embodiment of the present disclosure is described below by taking the structure in the organic light-emitting display panel shown in FIG. 4*a* as an example. In the following description, 1 refers to a high potential, and 0 refers to a low potential. It should be noted that 1 and 0 are logic potentials, which are only used for better explanation of the working process of the embodiment of the present disclosure, rather than the actual potential applied to the gate electrodes of the switching transistors.

First Embodiment

Figure 5A:
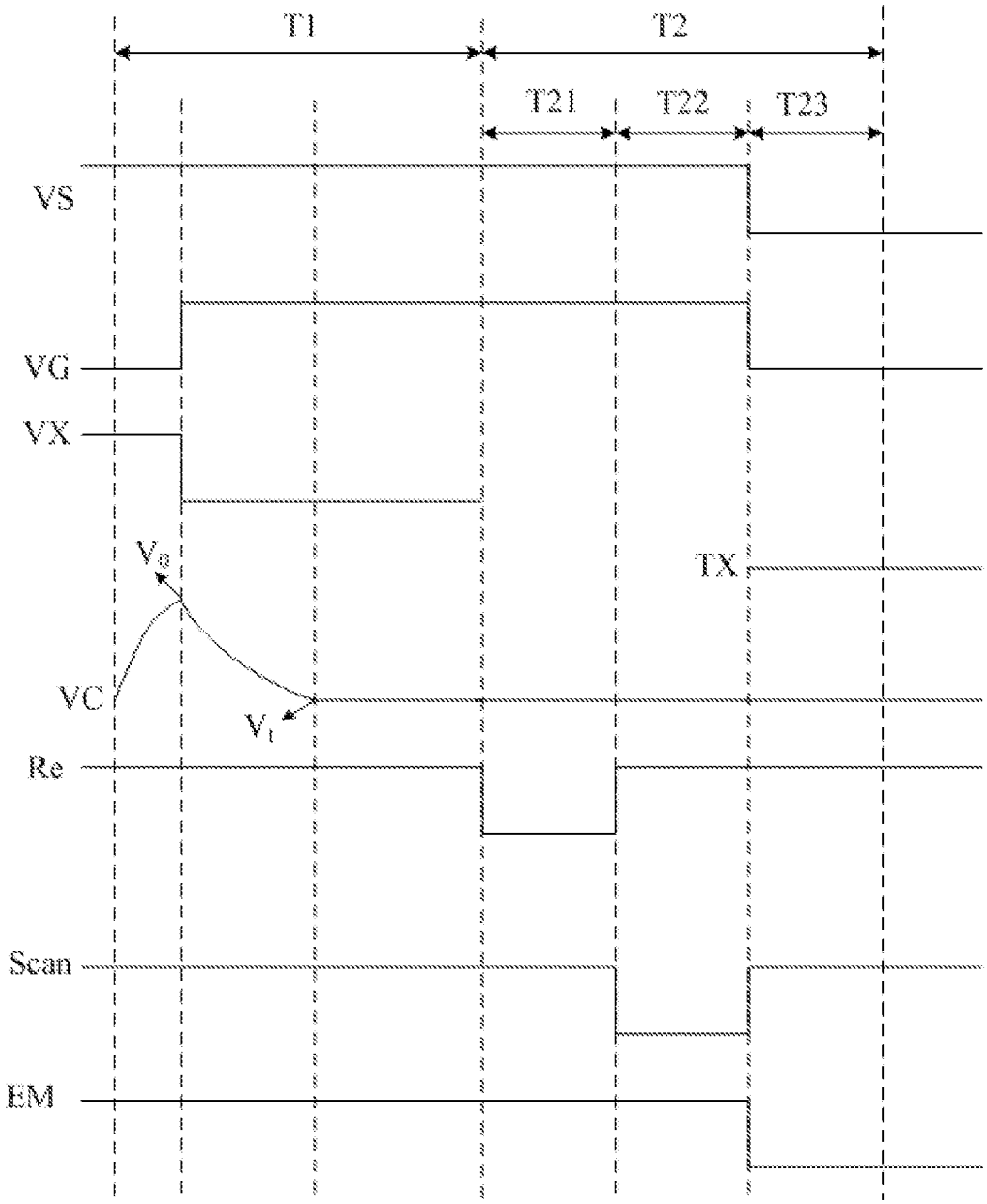
FIG. 5*a* is an input timing diagram corresponding to a first embodiment.

As illustrated by FIG. 4*a*, it is assumed that the temperature of the organic light-emitting display panel is not within the pre-set temperature range. The input timing diagram corresponding to the structure of the organic light-emitting display panel shown in FIG. 4*a* is illustrated by FIG. 5*a*. For example, a temperature detection phase T1 in the pre-set detection period in the input timing diagram shown in FIG. 5*a* and a display phase T2 after the temperature detection phase T1 are selected; during the temperature detection phase T1, temperature detection is performed, and the pixel compensation circuit does not work; during the display phase T2, the pixel compensation circuit works in three stages: T21, T22, and T23. VC in FIG. 5*a* represents the voltage at which the first capacitor C1 is charged and discharged.

During the T1 phase, VS=1, VG=0, Re=1, Scan=1, EM=1.

Because VG=0, the first switching transistor M1 is turned on. Because VS=1, the second switching transistor M2 is turned off. Because Re=1, the fourth switching transistor M4 and the fifth switching transistor M5 are both turned off. Because Scan=1, the third switching transistor M3 and the sixth switching transistor M6 are both turned off. Because EM=1, the seventh switching transistor M7 and the eighth switching transistor M8 are both turned off. The first switching transistor M1 which is turned on supplies a temperature detection signal VX outputted from the microprocessor MCU to the first end of the first capacitor C1 to charge the first capacitor C1. After the charging of the first capacitor C1 is completed, the voltage of the first capacitor C1 is V0.

Thereafter, VS=1, VG=1, Re=1, Scan=1, EM=1.

Because VS=1, the second switching transistor M2 is turned off. Because Re=1, the fourth switching transistor M4 and the fifth switching transistor M5 are both turned off. Because Scan=1, the third switching transistor M3 and the sixth switching transistor M6 are both turned off. Because EM=1, the seventh switching transistor M7 and the eighth switching transistor M8 are both turned off. Because VG=1, the first switching transistor M1 generates a leakage current; under the influence of the leakage current of the first switching transistor M1 and the potential of the temperature detection signal VX becoming a low potential, the first capacitor C1 is discharged, and the voltage the first capacitor C1 is finally discharged to $V_t$ after a discharge time t. The discharge time t and $V_t$ of the first capacitor C1 satisfy the discharge formula:

$$V_t = V_0 e^{\frac{-t}{RC}};$$

wherein R is an external resistor, and the resistor can be disposed in the microprocessor MCU, and C is the capacitance of the first capacitor C1. It can be seen from the formula that the microprocessor MCU can determine the discharge time t of the first capacitor C1 by detecting the voltage of the first capacitor C1, thereby achieving the function of detecting the discharge time t of the first capacitor C1.

The microprocessor MCU can determine the temperature of the organic light-emitting display panel according to the discharge time t as detected, can determine a temperature compensation voltage TX corresponding to the organic light-emitting display panel according to the temperature as determined, when it is determined that the temperature of the organic light-emitting display panel is not within the pre-set temperature range, for example, it is determined that the temperature of the organic light-emitting display panel is not within 26.9° C. to 27.1° C., and can apply the temperature compensation voltage TX as determined to the anodes of the light-emitting elements L through the second switching transistors M2 corresponding to the light-emitting elements L according to the temperature compensation voltage as determined.

During the T21 phase of the display phase T2, VS=1, VG=1, Re=0, Scan=1, EM=1.

Because Re=0, both the fourth switching transistor M4 and the fifth switching transistor M5 are turned on. Because VG=1, the first switching transistor M1 is turned off. Because VS=1, the second switching transistor M2 is turned off. Because Scan=1, both the third switching transistor M3 and the sixth switching transistor M6 are turned off. Because EM=1, both the seventh switching transistor M7 and the eighth switching transistor M8 are turned off. The fourth switching transistor M4 which is turned on supplies the signal of the first power terminal VDD to the first node A, thus, the voltage of the first node A is $V_{dd}$, that is, the voltage of the first end of the second capacitor C2 is Vss. The fifth switching transistor M5 which is turned on supplies the signal of the initialization signal terminal Vinit to the gate electrode G of the driving transistor M0, thus, the voltage of the gate electrode G of the driving transistor M0, that is, the second end of the second capacitor C2, is the voltage $V_{init}$ of the initialization signal terminal Vinit.

During the T22 phase, VS=1, VG=1, Re=1, Scan=0, EM=1.

Because Scan=0, both the third switching transistor M3 and the sixth switching transistor M6 are turned on. Because Re=1, both the fourth switching transistor M4 and the fifth switching transistor M5 are turned off. Because VG=1, the first switching transistor M1 is turned off. Because VS=1, the second switching transistor M2 is turned off. Because EM=1, both the seventh switching transistor M7 and the eighth switching transistor M8 are turned off. The third switching transistor M3 which is turned on supplies the signal of the data signal terminal Data to the first node A, thus, the voltage of the first node A is the voltage $V_{data}$ of the signal of the data signal terminal Data, that is, the voltage of the first end of the second capacitor C2 is $V_{data}$. The sixth switching transistor M6 which is turned on turns on the gate electrode G of the driving transistor M0 and the drain electrode D of the driving transistor M0, so that the driving transistor M0 is in a diode connection state, so that the first power terminal VDD can charge the second capacitor C2 through the driving transistor M0, until the voltage of the gate electrode G of the driving transistor M0, i.e., the second end of the second capacitor C2, becomes $V_{dd}+V_{th}$, wherein $V_{th}$ represents the threshold voltage of the driving transistor M0. Therefore, the voltage difference between the two ends of the second capacitor C2 is: $V_{dd}+V_{th}-V_{data}$.

During the T23 phase, VS=0, VG=0, Re=1, Scan=1, EM=0.

Because EM=0, both the seventh switching transistor M7 and the eighth switching transistor M8 are turned on. Because VG=0, the first switching transistor M1 is turned on. Because VS=0, the second switching transistor M2 is turned on. Because Scan=1, both the third switching transistor M3 and the sixth switching transistor M6 are turned off. Because Re=1, the fourth switching transistor M4 and the fifth switching transistor M5 are turned off. The seventh switching transistor M7 which is turned on supplies the signal of the reference signal terminal Vref to the first node A, so that the voltage of the first node A is $V_{ref}$. Because the gate electrode G of the driving transistor M0 is in a floating state, in order to ensure that the voltage difference between two ends of the second capacitor C2 is kept at: $V_{dd}+V_{th}-V_{data}$, the voltage of the second end of the second capacitor C2 leaps from $V_{dd}+V_{th}$ to $V_{dd}+V_{th}-V_{data}+V_{ref}$, i.e., the voltage of the gate electrode G of the driving transistor M0 is: $V_{dd}+V_{th}-V_{data}+V_{ref}$. In this case, the driving transistor M0 is in a saturated state, and the voltage of the source electrode of the driving transistor M0 is $V_{dd}$. According to the current characteristics of the saturation state, the current IL driving the light-emitting elements L to emit light satisfies the formula: $I_L=K(V_{GS}-V_{th})^2=K[(V_{dd}+V_{th}-V_{data}+V_{ref}-V_{dd})-V_{th}]^2=K(V_{ref}-V_{data})^2$, wherein $V_{GS}$ is a gate-source voltage of the driving transistor M0; K is a structural parameter, which is relatively stable in the same structure and can be regarded as a constant. In this case, the first switching transistor M1 which is turned on supplies the temperature compensation voltage TX outputted by the microprocessor MCU to the source electrode of the second switching transistor M2, and the second switching transistor M2 which is turned on supplies the temperature compensation voltage TX to the anode of the light-emitting element L as connected, such that a certain voltage is applied to the anode of the light-emitting elements L upon the temperature of the organic light-emitting display panel being not within 26.9° C. to 27.1° C., so as to make the brightness of the light-emitting elements L as close as possible to the brightness of the organic light-emitting display panel in the range of 26.9° C. to 27.1° C., so as to further improve the display effect of the organic light-emitting display panel. And it can be seen from, the abovementioned formula that the $I_L$ satisfies, that the current of the driving transistor M0 being in the saturation state is only related to the voltage $V_{ref}$ of the reference signal terminal Vref and the voltage $V_{data}$ of the data signal terminal Data, while irrelevant to the threshold voltage Vth of the driving transistor M0 and the voltage Vss of the first power source terminal VDD. Therefore, the threshold voltage Vth drift caused by the manufacturing process of the driving transistor M0 and the long-time operation, and the influence of the IR drop on the current flowing through the light-emitting elements L can be solved, thereby keeping working current of the light-emitting elements L stable, so as to further ensure that the organic light-emitting display panel works normally.

The first embodiment of the present disclosure can perform voltage compensation to the anode of every the light-emitting element upon every the light-emitting element emitting light, thereby eliminating color-bias phenomenon exhibited by the light-emitting elements caused by a temperature variation, so as to improve the display effect of the organic light-emitting panel. Moreover, because the pixel compensation circuit can also solve the threshold voltage Vth drift caused by the manufacturing process of the driving transistor M0 and the long-time operation, and the influence of the IR drop on the current flowing through the light-emitting elements L can be solved, thereby keeping working current of the light-emitting elements L stable, so as to further ensure that the organic light-emitting display panel works normally.

Second Embodiment

Figure 5B:
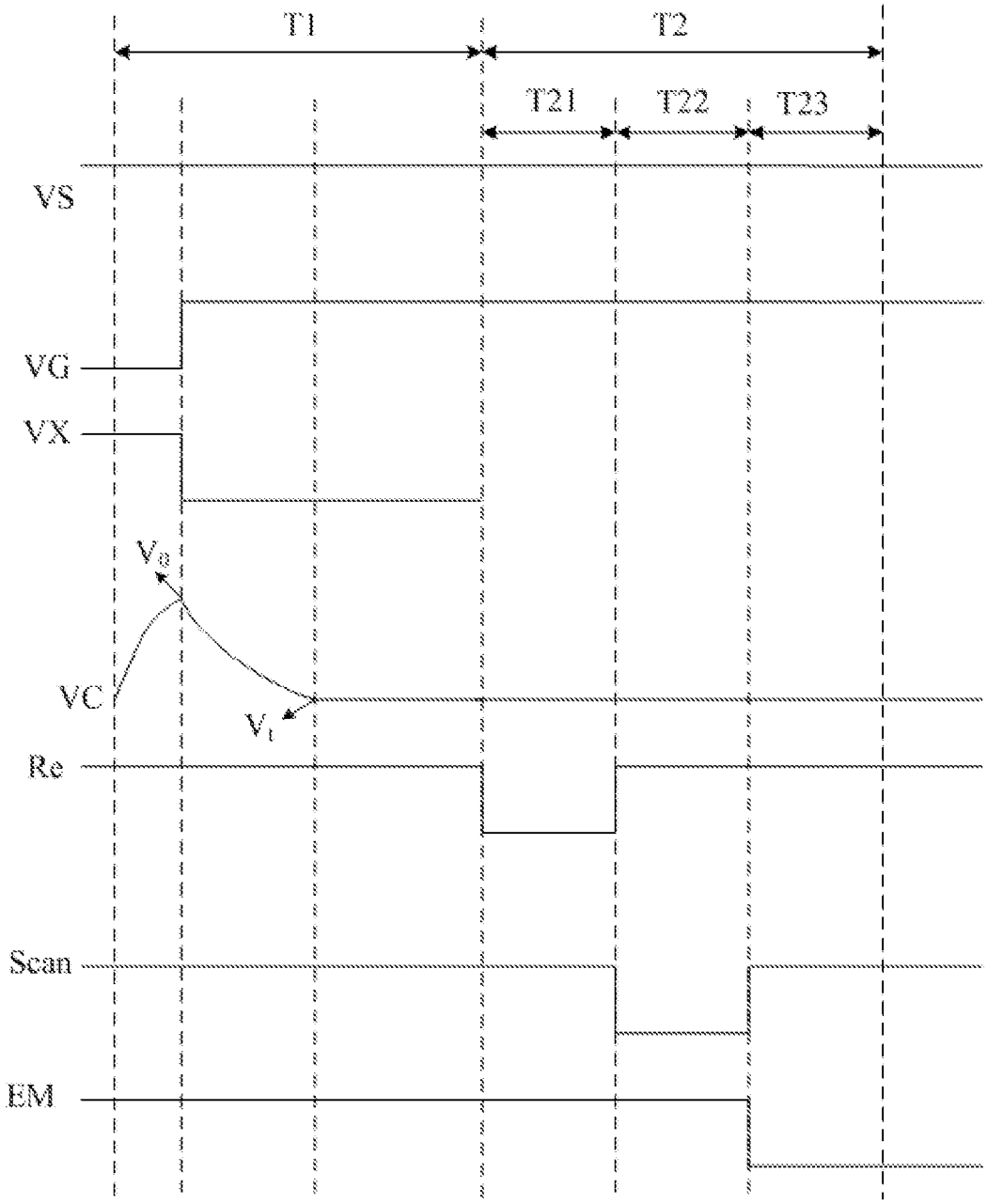
FIG. 5*b* is an input timing diagram corresponding to a second embodiment.

As illustrated by FIG. 4*a*, it is assumed that the temperature of the organic light-emitting display panel is within the pre-set temperature range. The input timing diagram corresponding to the structure of the organic light-emitting display panel shown in FIG. 4*a* is illustrated by FIG. 5*b*. For example, a temperature detection phase T1 in the pre-set detection period in the input timing diagram shown in FIG. 5*b* and a display phase T2 after the temperature detection phase T1 are selected; during the temperature detection phase T1, temperature detection is performed, and the pixel compensation circuit does not work; during the display phase T2, pixel compensation circuit works in three stages: T21, T22, and T23. VC in FIG. 5*b* represents the voltage at which the first capacitor C1 is charged and discharged.

During the T1 phase, VS=1, VG=0, Re=1, Scan=1, EM=1. The working process is basically the same as the working process of the T1 phase in the first embodiment, and will not be repeated here.

Thereafter, VS=1, VG=1, Re=1, Scan=1, EM=1.

Because VS=1, the second switching transistor M2 is turned off. Because Re=1, both the fourth switching transistor M4 and the fifth switching transistor M5 are turned off. Because Scan=1, both the third switching transistor M3 and the sixth switching transistor M6 are turned off. Because EM=1, both the seventh switching transistor M7 and the eighth switching transistor M8 are turned off. Because VG=1, the first switching transistor M1 generates leakage current, and under the influence of the leakage current of the first switching transistor M1 and the potential of the temperature detection signal VX becoming a low potential, the first capacitor C1 is discharged, and finally voltage of the first capacitor C1 becomes $V_t$ after being discharged for a discharge time t. The discharge time t and Vt of the first capacitor C1 satisfy the discharge formula:

$$V_t = V_0 e^{\frac{-t}{RC}},$$

wherein R is an external resistor, and the resistor can be disposed in the microprocessor MCU, C is the capacitance of the first capacitor C1. It can be seen from the formula that the microprocessor MCU can determine the discharge time t of the first capacitor C1 by detecting the voltage of the first capacitor C1, thereby achieving the function of detecting the discharge time t of the first capacitor C1.

The microprocessor MCU can determine the temperature of the organic light-emitting display panel according to the detected discharge time t. The microprocessor MCU does not perform determining of the temperature compensation voltage corresponding to the organic light-emitting display panel when it is determined that the temperature of the organic light-emitting display panel is within a pre-set temperature range, for example, it is determined that the temperature of the organic light-emitting display panel is within 26.9° C. to 27.1° C. That is, the anode of the light-emitting element L is not subjected to voltage compensation.

During the T21 phase of the display phase T2, VS=1, VG=1, Re=0, Scan=1, EM=1. The working process is basically the same as the working process of the T21 phase in the first embodiment, and will not be repeated here.

During the T22 phase, VS=1, VG=1, Re=1, Scan=0, EM=1. The working process is basically the same as the working process of the T22 phase in the first embodiment, and will not be repeated here.

During the T23 phase, VS=0, VG=0, Re=1, Scan=1, EM=0.

Because EM=0, both the seventh switching transistor M7 and the eighth switching transistor M8 are turned on. Because VG=0, the first switching transistor M1 is turned on. Because VS=0, the second switching transistor M2 is turned on. Because Scan=1, both the third switching transistor M3 and the sixth switching transistor M6 are turned off. Because Re=1, both the fourth switching transistor M4 and the fifth switching transistor M5 are turned off. The seventh switching transistor M7 which is turned on supplies the signal of the reference signal terminal Vref to the first node A, so that the voltage of the first node A is $V_{ref}$. Because the gate electrode G of the driving transistor M0 is in a floating state, in order to ensure that the voltage difference between two ends of the second capacitor C2 is kept at $V_{dd}+V_{th}-V_{data}$, the voltage of the second end of the second capacitor C2 leaps from $V_{dd}+V_{th}$ to $V_{dd}+V_{th}-V_{data}+V_{ref}$, i.e., the voltage of the gate electrode G of the driving transistor M0 is: $V_{dd}+V_{th}-V_{data}+V_{ref}$. In this case, the driving transistor M0 is in a saturated state, and the voltage of the source electrode of the driving transistor M0 is $V_{dd}$. According to the current characteristics of the saturation state, the current $I_L$ driving the light-emitting elements L to emit light satisfies the formula: $I_L=K(V_{GS}-V_{th})^2=K[(V_{dd}+V_{th}-V_{data}+V_{ref}-V_{dd})-V_{th}]^2=K(V_{ref}-V_{data})^2$, wherein $V_{GS}$ is a gate-source voltage of the driving transistor M0; K is a structural parameter, which is relatively stable in the same structure and can be regarded as a constant. And it can be seen from, the abovementioned formula that the $I_L$ satisfies, that the current of the driving transistor M0 being in the saturation state is only related to the voltage $V_{ref}$ of the reference signal terminal Vref and the voltage $V_{data}$ of the data signal terminal Data, while irrelevant to the threshold voltage Vth of the driving transistor M0 and the voltage $V_{dd}$ of the first power source terminal VDD. Therefore, the threshold voltage Vth drift caused by the manufacturing process of the driving transistor M0 and the long-time operation, and the influence of the IR drop on the current flowing through the light-emitting elements L can be solved, thereby keeping working current of the light-emitting elements L stable, so as to further ensure that the organic light-emitting display panel works normally.

In the second embodiment of the present disclosure, upon detecting that the temperature of the organic light-emitting display panel satisfies the pre-set temperature range, voltage compensation is not performed to the anode voltage of the light-emitting element, so that additional power consumption can be avoided. Besides, the abovementioned pixel compensation circuit can further solve the threshold voltage Vth drift caused by the manufacturing process of the driving transistor M0 and the long-time operation, and the influence of the IR drop on the current flowing through the light-emitting elements L, thereby keeping working current of the light-emitting elements L stable, so as to further ensure that the organic light-emitting display panel works normally.

Figure 6:
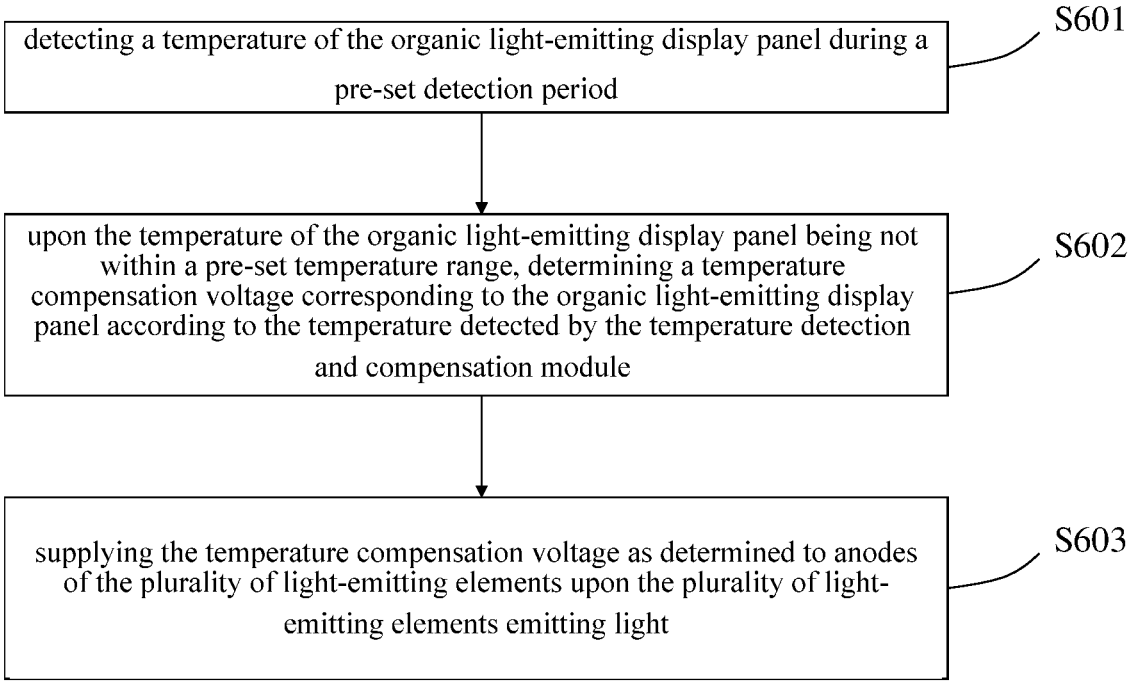
FIG. 6 is a flow diagram of a display method provided by an embodiment of the present disclosure.

Based on the same inventive concept, an embodiment of the present disclosure further provides a display method for any one of the abovementioned organic light-emitting display panels according to the embodiments of the present disclosure. The organic light-emitting display panel includes a plurality of light-emitting elements, as illustrated by FIG. 6, the method includes:

S601: detecting a temperature of the organic light-emitting display panel during a pre-set detection period;

S602: upon the temperature of the organic light-emitting display panel being not within a pre-set temperature range, determining a temperature compensation voltage corresponding to the organic light-emitting display panel according to the temperature detected by the temperature detection and compensation module;

S603: supplying the temperature compensation voltage as determined to anodes of the plurality of light-emitting elements when the plurality of light-emitting elements emit light.

The abovementioned display method for the organic light-emitting display panel according to the embodiment of the present disclosure detects the temperature of the organic light-emitting display panel during the pre-set detection period, and determine the temperature compensation voltage corresponding to the organic light-emitting display panel according to the temperature detected by the temperature detection and compensation module upon the temperature of the organic light-emitting display panel being not within a pre-set temperature range. Therefore, the temperature compensation voltage as determined can be supplied to the anodes of the plurality of light-emitting elements when every light-emitting element emits light, according to the temperature compensation voltage as determined. In this way, the color-bias phenomenon of the light-emitting elements caused by a temperature variation can be eliminated, thereby improving the display effect of the organic light-emitting display panel.

For example, in the abovementioned display method provided by the embodiment of the present disclosure, the pre-set temperature range can be 26.9° C. to 27.1° C., or 26° C. to 28° C. Certainly, in practical applications, the pre-set temperature range can be determined and designed according to the actual application environment.

For example, in the abovementioned display method provided by the embodiment of the present disclosure, the pre-set detection period can be a time interval of M display frames, wherein M is an integer greater than or equal to 1. For example, the pre-set detection period can be a time interval of one display frame, so that the temperature of the organic light-emitting display panel can be accurately acquired. Alternatively, the pre-set detection period can be a time interval of five display frames, so that power consumption of the organic light-emitting display panel can be reduced. The pre-set detection period can be determined according to the actual application environment, and is not limited herein.

For example, in the abovementioned display method provided by the embodiment of the present disclosure, detecting the temperature of the organic light-emitting display panel in the pre-set detection period can include: during the pre-set detection period, supplying a temperature detection signal to the voltage storage sub-module so as to charge and discharge the voltage storage sub-module; detecting a discharge time of the voltage storage sub-module upon the voltage storage sub-module discharging; and determining the temperature of the organic light-emitting display panel according to the discharge time as detected.

And, supplying the temperature compensation voltage as determined to the anodes of the plurality of light-emitting elements includes: supplying the temperature compensation voltage as determined to the anodes of the plurality of light-emitting elements which are emitting light through the plurality of compensation input sub-modules corresponding to the plurality of light-emitting elements which are emitting light.

The organic light-emitting display panel and the display method thereof provided by the embodiment of the present disclosure can detect the temperature of the organic light-emitting display panel during the pre-set detection period by arranging the temperature detection and compensation module, and determine the temperature compensation voltage corresponding to the organic light-emitting display panel according to the temperature detected by the temperature detection and compensation module upon the temperature of the organic light-emitting display panel being not within a pre-set temperature range, so as to supply the temperature compensation voltage as determined to the anodes of the plurality of light-emitting elements upon every light-emitting element emitting light according to the temperature compensation voltage as determined. In this way, the color-bias phenomenon exhibited by the light-emitting elements caused by a temperature variation can be eliminated, thereby improving the display effect of the organic light-emitting display panel.

The foregoing are only specific embodiments of the present disclosure, but the scope of protection of the present disclosure is not limited thereto, and the scope of protection of the present disclosure is subject to the scope of protection of the claims.

The present application claims priority of China Patent application No. 201710329211.3 filed on May 11, 2017, the content of which is incorporated in its entirety as portion of the present application by reference herein.

What is claimed is:

1. An organic light-emitting display panel, comprising a plurality of light-emitting elements, wherein the organic light-emitting display panel further comprises: a temperature detection and compensation module electrically connected to anodes of the respective light-emitting elements;

the temperature detection and compensation module is configured to: detect a temperature of the organic light-emitting display panel during a pre-set detection period, to determine a temperature compensation voltage corresponding to the organic light-emitting display panel according to the temperature detected by the temperature detection module when it is determined that the temperature of the organic light-emitting display panel is not within a pre-set temperature range, and to apply the temperature compensation voltage as detected to the anodes of the light-emitting elements when the organic light-emitting elements emit light;

the temperature detection and compensation module comprise: a signal input sub-module, a voltage storage sub-module, a data processing sub-module, and compensation input sub-modules having a same number as that of the light-emitting elements, and each of the compensation input sub-modules is connected to the anode of the corresponding one of the light-emitting elements;

the signal input sub-module is connected to the data processing sub-module, the voltage storage sub-module and the compensation input sub-modules, and the signal input sub-module is configured to provide a temperature detection signal outputted by the data processing sub-module to the voltage storage sub-module during the pre-set detection period, and to provide a temperature compensation voltage output by the data processing sub-module to the compensation input sub-modules when the respective light-emitting devices emits light;

the voltage storage sub-module is further connected to a ground end, and is configured to be charged or discharged under a control of the ground end and the temperature detection signal as received;

the data processing sub-module is further connected to the voltage storage sub-module, and is configured to: output the temperature detection signal, to detect a discharge time of the voltage storage sub-module when the voltage storage sub-module is discharged, to determine the temperature of the organic light-emitting display panel according to the discharge time as detected, to determine the temperature compensation voltage corresponding to the organic light-emitting display panel according to the temperature as detected when it is determined that the temperature of the organic light-emitting display panel is not within the pre-set temperature range, and to apply the temperature compensation voltage as determined to the anodes of the respective light-emitting elements through the compensation sub-modules corresponding to the respective light-emitting elements;

each of the compensation input sub-modules is configured to input the temperature compensation voltage as detected to the anode of the light-emitting element connected therewith when the light-emitting element connected therewith emits light.

2. The organic light-emitting display panel according to claim 1, wherein the signal input sub-module, the voltage storage sub-module, and the compensation input sub-modules are located in a display region of the organic light-emitting display panel.

3. The organic light-emitting display panel according to claim 2, wherein the display region comprises a plurality of pixel units, one voltage storage sub-module and one signal input sub-module, each of the pixel units comprises one light-emitting element and one compensation input sub-module.

4. The organic light-emitting display panel according to claim 3, wherein the data processing sub-module is configured to detect a discharge time of the voltage storage sub-module when the voltage storage sub-module is discharged, to determine a temperature of the display region according to the discharge time as detected, to determine a temperature compensation voltage corresponding to the display region according to the temperature as detected when it is determined that the temperature of the display region is not within the pre-set temperature range, and to apply the temperature compensation voltage as determined to the anodes of the respective light-emitting elements through the compensation input sub-modules corresponding to the respective light-emitting elements.

5. The organic light-emitting display panel according to claim 2, wherein the display region comprises a plurality of display sub-regions, each of the display sub-regions comprises: at least one pixel unit, one voltage storage sub-module, and one signal input a sub-module; each pixel unit comprises one light-emitting element and one compensation input sub-module.

6. The organic light-emitting display panel according to claim 5, wherein the data processing sub-module is configured to detect a discharge time of the voltage storage sub-module in the respective display sub-regions when the voltage storage sub-module in the respective display sub-regions is discharged, to determine a temperature corresponding to each of the display sub-regions according to the discharge time as detected of each of the voltage storage sub-module, to determine a temperature compensation voltage corresponding to the respective display sub-regions according to the temperature corresponding to each of the display sub-regions when it is determined that the temperature as detected of each of the display sub-pixels is not within the pre-set temperature range, and to supply the temperature compensation voltage as determined to the anodes of the respective light-emitting element through the compensation input sub-modules corresponding to the respective light-emitting elements.

7. The organic light-emitting display panel according to claim 1, wherein the signal input sub-module comprises: a first switching transistor; wherein a control electrode of the first switching transistor is connected to an input control signal terminal, a first electrode of the first switching transistor is connected with the data processing sub-module, and a second electrode of the first switching transistor is connected to the voltage storage sub-module and the compensation input sub-modules.

8. The organic light-emitting display panel according to claim 1, wherein the compensation input sub-module comprises: a second switching transistor; wherein a control electrode of the second switching transistor is connected to a compensation control signal terminal, a first electrode of the second switching transistor is connected to the signal input sub-module, and a second electrode of the second switching transistor is connected to the anode of the corresponding one of the light-emitting elements.

9. The organic light-emitting display panel according to claim 1, wherein the voltage storage sub-module comprises: a first capacitor; wherein a first end of the first capacitor is connected to the signal input sub-module and the data processing sub-module, and a second end of the first capacitor is connected to a ground end.

10. A display method for the organic light-emitting display panel according to any one of claim 1, the organic light-emitting display panel comprising a plurality of light-emitting elements, wherein the display method comprises:

detecting a temperature of the organic light-emitting display panel during a pre-set detection period;

when the temperature of the organic light-emitting display panel is not within a pre-set temperature range, determining a temperature compensation voltage corresponding to the organic light-emitting display panel according to the temperature detected by the temperature detection and compensation module; and supplying the temperature compensation voltage as determined to anodes of the light-emitting elements when the light-emitting elements emit light.

11. The display method according to claim 10, wherein detecting the temperature of the organic light-emitting display panel during the pre-set detection period comprises:

supplying a temperature detection signal to the voltage storage sub-module during the pre-set detection period to charge and discharge the voltage storage sub-module; detecting a discharge time of the voltage storage sub-module when the voltage storage sub-module is discharged; and determining the temperature of the organic light-emitting display panel according to the discharge time as detected.

12. The display method according to claim 11, wherein supplying the temperature compensation voltage as determined to the anodes of the light-emitting elements comprises: supplying the temperature compensation voltage as determined to the anodes of the light-emitting elements that are emitting light through the compensation input sub-modules corresponding to the light-emitting elements that are emitting light.

13. The display method according to claim 10, wherein supplying the temperature compensation voltage as determined to the anodes of the light-emitting elements comprises: supplying the temperature compensation voltage as determined to the anodes of the light-emitting elements that are emitting light through the compensation input sub-modules corresponding to the light-emitting elements that are emitting light.

14. The organic light-emitting display panel according to claim 1, wherein the signal input sub-module comprises: a first switching transistor; wherein a control electrode of the first switching transistor is connected to an input control signal terminal, a first electrode of the first switching transistor is connected with the data processing sub-module, and a second electrode of the first switching transistor is connected to the voltage storage sub-module and the compensation input sub-modules.

15. The organic light-emitting display panel according to claim 1, wherein the compensation input sub-module comprises: a second switching transistor; wherein a control electrode of the second switching transistor is connected to a compensation control signal terminal, a first electrode of the second switching transistor is connected to the signal input sub-module, and a second electrode of the second switching transistor is connected to the anode of the corresponding one of the light-emitting elements.

16. The organic light-emitting display panel according to claim 1, wherein the voltage storage sub-module comprises: a first capacitor; wherein a first end of the first capacitor is connected to the signal input sub-module and the data processing sub-module, and a second end of the first capacitor is connected to a ground end.

* * * * *